US007507128B2

(12) United States Patent
West et al.

(10) Patent No.: US 7,507,128 B2
(45) Date of Patent: Mar. 24, 2009

(54) POWER SYSTEM FOR WATERCRAFT

(75) Inventors: John H. West, Whitewater, WI (US); Richard J. Page, Lake Villa, IL (US)

(73) Assignee: Bomboard LLC, Whitewater, WI (US)

( * ) Notice: Subject to any disclaimer, the term of this patent is extended or adjusted under 35 U.S.C. 154(b) by 0 days.

(21) Appl. No.: 11/695,360

(22) Filed: Apr. 2, 2007

(65) Prior Publication Data

US 2007/0281561 A1 Dec. 6, 2007

Related U.S. Application Data

(63) Continuation-in-part of application No. 11/446,653, filed on Jun. 5, 2006, now Pat. No. 7,426,896.

(51) Int. Cl.
*B63H 11/00* (2006.01)
*B63B 35/73* (2006.01)
*B63B 25/00* (2006.01)

(52) U.S. Cl. ..... 440/38; 114/55.58; 114/246

(58) Field of Classification Search ..... 440/38
See application file for complete search history.

(56) References Cited

U.S. PATENT DOCUMENTS

| | | | |
|---|---|---|---|
| 3,183,878 | A | 5/1965 | Aschauer |
| 3,889,623 | A | 6/1975 | Arnold |
| 3,935,833 | A | 2/1976 | Onal |
| 4,004,541 | A | 1/1977 | Onal |
| 4,020,782 | A | 5/1977 | Gleason |
| 4,171,675 | A | 10/1979 | Thompson |
| 4,350,113 | A | 9/1982 | Moreau et al. |
| 4,417,877 | A | 11/1983 | Krautkremer et al. |
| 4,538,996 | A | 9/1985 | Inwood |
| D307,258 | S | 4/1990 | Monostorv |
| 4,932,347 | A | 6/1990 | Mardikian |
| 5,100,289 | A | 3/1992 | Caoduro |
| 5,255,625 | A | 10/1993 | Hattori |

(Continued)

FOREIGN PATENT DOCUMENTS

| | | | |
|---|---|---|---|
| FR | 2515138 | A | 4/1983 |

OTHER PUBLICATIONS

PCT, Partial International Search Report, PCT/US2008/059037, completed on Jul. 23, 2008.

*Primary Examiner*—Jesus D Sotelo
(74) *Attorney, Agent, or Firm*—Boyle Fredrickson, S.C.

(57) ABSTRACT

Personal watercraft systems and watercraft power systems are described. The personal watercraft power systems include a housing for supporting a water jet pump and engine system. The housing is constructed to support the power system and removably engage a watercraft. An engine and a centrifugal pump are enclosed in the housing and operatively connected by an endless drive, such as a belt. A crankshaft of the engine is generally aligned and offset for a pump shaft of the centrifugal pump. An impeller is connected to the pump shaft and is constructed in rotate in a plane generally aligned, and preferably offset from, a plane of a water surface. The orientation of the engine and the centrifugal pump provides a watercraft power system that has a reduced profile and is particularly applicable for watercraft constructed to support an operator in a prone position. The housing is constructed to removably engage a number of watercraft configurations and provides a watercraft power system that is easily serviceable, highly versatile and dynamic.

20 Claims, 14 Drawing Sheets

U.S. PATENT DOCUMENTS 5,362,269 A 11/1994 Leach
5,388,543 A 2/1995 Ditchfield
5,394,820 A 3/1995 Dach
5,399,111 A 3/1995 Kobayashi et al.
5,443,028 A 8/1995 Keen
5,476,401 A 12/1995 Peterson et al.
5,501,072 A 3/1996 Plancich et al.
5,582,529 A 12/1996 Montgomery
5,779,444 A 7/1998 Onigata et al.
5,782,664 A 7/1998 Casters
5,876,258 A 3/1999 Gray
5,938,490 A 8/1999 Rodler
6,132,269 A * 10/2000 Belt ..... 440/38
6,192,817 B1 2/2001 Dec et al.
6,227,802 B1 5/2001 Torgerson et al.
6,237,522 B1 5/2001 Kiyohara et al.
6,247,422 B1 6/2001 Murray, III
6,386,931 B1 * 5/2002 Nanami ..... 440/111
6,712,652 B2 * 3/2004 Roycroft ..... 440/12.51
D509,784 S 9/2005 Chase
7,311,574 B2 * 12/2007 Roos ..... 440/111
2002/0056408 A1 5/2002 Dec et al.
2003/0032344 A1 2/2003 Blanchard
2005/0268833 A1 12/2005 Conrad
2007/0125285 A1 6/2007 Conrad

* cited by examiner

POWER SYSTEM FOR WATERCRAFT

CROSS-REFERENCE TO RELATED APPLICATIONS

This application in a continuation-in-part and claims priority to U.S. Non-provisional patent application Ser. No. 11/446,653 filed on Jun. 5, 2006 now U.S. Pat. No. 7,426,896 titled "Prone Operator Position Personal Watercraft".

BACKGROUND OF THE INVENTION

1. Field of the Invention

The present invention relates generally to the field of watercrafts and, more particularly, to jet-powered personal watercraft (PWC). Specifically, a preferred embodiment of the present invention relates to jet-powered personal watercraft constructed for operation by an operator in a prone position and having a power system removably connected to the watercraft. The present invention is particularly applicable to a personal watercraft of the type that can be termed prone operator position jet-powered watercraft.

2. Discussion of the Related Art

Historically, it was known in the prior art to provide a jet-powered personal watercraft of the type generally hereunder consideration. A conventional personal watercraft is typically understood as a watercraft constructed to support one operator and possibly as many as two passengers. Typically, the operator is oriented in a standing or seated position. For example, a personal watercraft constructed to support a passenger in addition to an operator generally requires a configuration wherein the passenger and the operator are positioned in a seated orientation. Providing a personal watercraft where the operator is supported in a prone position provides a personal watercraft that is uniquely controllable and operable, thereby overcoming what may be perceived as the tedium associated with conventional personal watercraft.

Another drawback of conventional personal watercraft is the relative size thereof. A majority of such watercraft are constructed to support an operator and/or passengers at a position above a surface of the water of the operating environment. Such operation requires the personal watercraft be constructed of sufficient size to provide a buoyant force equal to the weight of the personal watercraft, as well as the weight of the operator and/or passengers. Accordingly, such conventional personal watercrafts are relatively bulky. The size of such devices complicates non-operating transportation of the watercraft.

Another drawback of known personal watercraft systems is the relatively monolithic construction of such devices. Such devices commonly include a plurality of components, including an engine disposed within a one-piece waterproof hull. Frequently removing components from within the hull is a time consuming and laborious process. Furthermore, servicing of the components of the personal watercraft requires either removal of the component directly therefrom or transportation of the entirety of the personal watercraft. Such transportation is commonly facilitated via a trailer, which is configured to directly support the personal watercraft. That is, such watercraft is substantially non-shippable. The relatively unitary construction of such assemblies prevents convenient and economical transportation of the personal watercraft for servicing and the like. Such devices are commonly locally serviced due in part to the inconvenient transportation of the device or components thereof.

Therefore, it would be desirable to design a personal watercraft constructed to support an operator in a prone position, which is separable and therefore easily transportable. It is further desirable to provide a watercraft power system that is removable, compact and lightweight to allow separate transport of the watercraft and power system and yet powerful and robust.

SUMMARY OF THE INVENTION

By way of summary, the present invention is directed to a versatile and reduced profile watercraft power system that overcomes the aforementioned drawbacks. The personal watercraft power system includes a housing for supporting a water jet pump and engine system. The housing is constructed to support the power system and to removably engage a watercraft. An engine and a centrifugal pump are enclosed in the housing and operatively connected by an endless drive, such as a belt. A crankshaft of the engine is generally aligned and offset for a pump shaft of the centrifugal pump. An impeller is connected to the pump shaft and is constructed in rotate in plane generally aligned, and preferably offset, from a plane of a water surface. The orientation of the engine and the centrifugal pump provides a watercraft power system that has a reduced profile and is particularly applicable for watercraft constructed to support an operator in a prone position. The housing is constructed to removably engage a number of watercraft configurations and provides a watercraft power system that is easily serviceable, highly versatile and dynamic.

Therefore, according to one aspect of the invention, a watercraft power system having an engine, a centrifugal pump, and an endless drive is disclosed. A housing is constructed to removably engage a hull of a watercraft and is positioned about the engine and the centrifugal pump. The housing has a first opening for being positioned about an inlet of the centrifugal pump and a second opening for being positioned about a discharge of the centrifugal pump such that the power system can be operatively connected to a watercraft by simply positioning the housing in a hull of a watercraft.

Another aspect of the invention discloses a watercraft power pod having an engine, a pump, and an endless drive. The engine has a piston positioned in a cylinder and connected to a crankshaft. The pump has a centrifugal impeller connected to a pump shaft oriented generally parallel to, and offset from, the crankshaft. The endless drive connects the crankshaft to the pump shaft and is generally aligned and offset from a plane of rotation of the impeller. Such an orientation provides a compact, low-profile watercraft power system.

A further aspect of the invention discloses a removable watercraft power system having a centrifugal pump, an engine, and an endless drive. The pump includes an impeller that is generally aligned with a water surface and the engine includes a cylinder that is generally aligned with the impeller. The endless drive is connected between the engine and the centrifugal pump and is generally aligned and offset from the cylinder and the impeller. A pump shaft is connected to the impeller and the endless drive and extends in a crossing direction relative to the impeller. A crankshaft is connected to the engine and the endless drive and extends in a crossing direction relative to the cylinder and is offset from the pump shaft. Such a construction provides a watercraft power system that is configured to conveniently power a variety of watercraft configurations.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
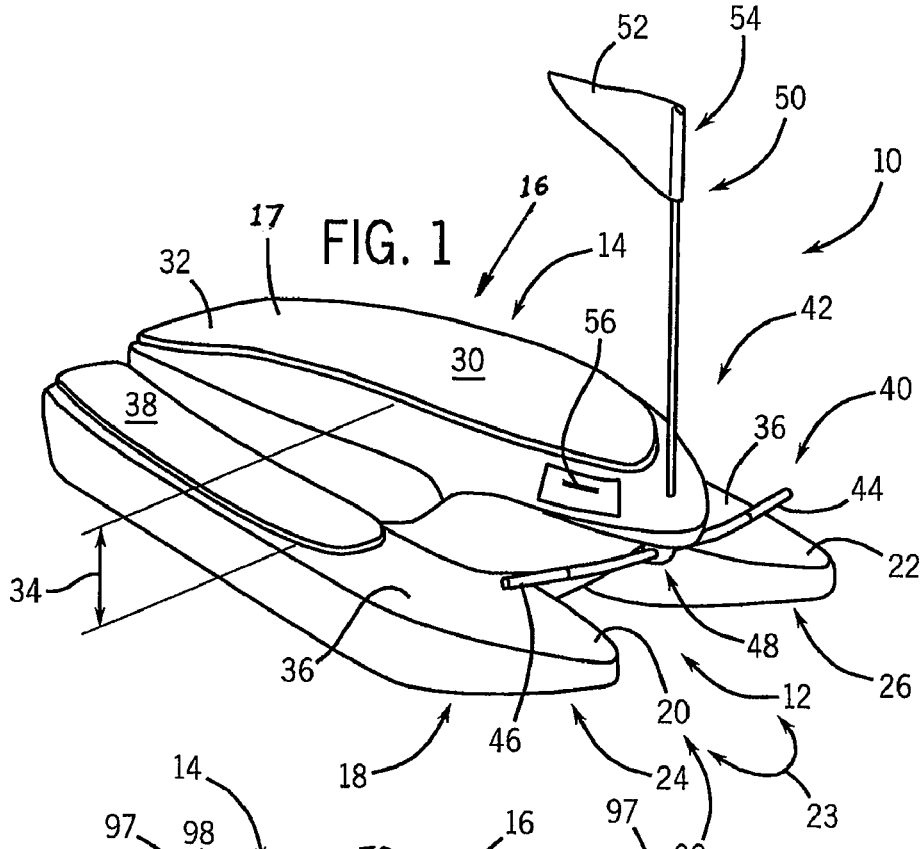
FIG. 1 shows a perspective view of a personal watercraft according to the present invention.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The above-mentioned requirements of operability and transportability are mutually contradicting and cannot be satisfied simultaneously in the case of conventional personal watercraft. However, it is rendered possible to simultaneously satisfy these requirements to a certain extent by employing a separable component hull in consideration of the fact that a user operates the personal watercraft in a prone position.

Personal watercraft systems and watercraft power systems are described herein. The personal watercraft systems preferably include a housing for supporting a water jet engine system. The housing preferably has a pickle fork shaped hull for operation enjoyment. A pair of sponsons is removably attachable to the housing to facilitate breakdown of the watercraft system assembly into more easily transportable components. The water jet engine system has a water jacket about the engine. A cowling with a support is attached to the housing to support a torso area of an operator. A seal is disposed between the cowling and the housing for sealing the interface therebetween and absorbing impacts. A steering mechanism is connected to the personal watercraft system for allowing an operator to control the personal watercraft systems direction of travel. The steering mechanism is located below the hull and cowling for preventing inadvertent operator contact therewith. The systems provide advantages in greater operator comfort and enjoyment from operation of personal watercraft.

The personal watercraft power systems include a housing for supporting a water jet pump and engine system. The housing is constructed to support the power system and removably engage a watercraft. An engine and a centrifugal pump are enclosed in the housing and operatively connected by an endless drive, such as a belt. A crankshaft of the engine is generally aligned and offset for a pump shaft of the centrifugal pump. An impeller is connected to the pump shaft and is constructed in rotate in plane generally aligned, and preferably offset, from a plane of a water surface. The orientation of the engine and the centrifugal pump provides a watercraft power system that has a reduced profile and is particularly applicable for watercraft constructed to support an operator in a prone position. The housing is constructed to removably engage a number of watercraft configurations and provides a watercraft power system that is easily serviceable, highly versatile and dynamic.

Therefore, one embodiment of the invention includes a watercraft power system having an engine, a centrifugal pump having an inlet and a discharge, and an endless drive for operatively connecting the centrifugal pump to the engine. A housing is constructed for removably engaging a hull of a watercraft and positioned about the engine and the centrifugal pump. The housing has a first opening for being positioned about the inlet and a second opening for being positioned about the discharge such that the power system can be operatively connected to a watercraft by simply positioning the housing in a hull of a watercraft.

Another embodiment of the invention includes a watercraft power pod having an engine, a pump, and an endless drive. The engine has a piston positioned in a cylinder and connected to a crankshaft. The pump has a centrifugal impeller connected to a pump shaft oriented generally parallel to, and offset from, the crankshaft. The endless drive connects the crankshaft to the pump shaft and is generally aligned and offset from a plane of rotation of the impeller. Such an orientation provides a compact, low-profile watercraft power system.

A further embodiment of the invention includes a removable watercraft power system having a centrifugal pump, an engine, and an endless drive. The pump includes an impeller that is generally aligned with a water surface and the engine includes a cylinder that is generally aligned with the impeller. The endless drive is connected between the engine and the centrifugal pump and is generally aligned and offset from the cylinder and the impeller. A pump shaft is connected to the impeller and the endless drive and extends in a crossing direction relative to the impeller. A crankshaft is connected to the engine and the endless drive and extends in a crossing direction relative to the cylinder and is offset from the pump shaft. Such a construction provides a watercraft power system that snuggly fits within a number of watercraft configurations.

2. Detailed Description of Preferred Embodiments

FIG. 1 shows a watercraft apparatus, preferably a personal marine system, such as a personal watercraft 10 according to the present invention. Personal watercraft 10 includes a body, for example, a housing, enclosure, or hull assembly 12 constructed to allow flotation and planing of personal watercraft 10 upon a water surface. Hull assembly 12 includes a plane, e.g., surface or topside 14 having a panel, such as a cover or cowling 16 including a preferably padded seat 17 pivotably connected thereto. Seat 17 is constructed and configured to engage a torso, e.g., an operator torso or a chest area during operation of the personal watercraft 10. A bottom surface or bottom side 18 of body or hull assembly 12 is constructed to engage a water surface such that, during operation of personal watercraft 10, a bottom side 18 of personal watercraft 10 planes across a surface of the operating environment, e.g., a lake.

At least one float or sponson 20, 22 is removably attached to hull assembly 12. Preferably, a pair of sponsons 20, 22 form a first protrusion 24 and a second protrusion 26 on bottom side 18 of personal watercraft 10. As such, sponsons 20, 22 cooperatively form a unique shape 28 of bottom side 18. Preferably, this shape forms a generally V-shaped or a "pickle fork" shaped underside 23 of hull assembly 12. Sponsons 20, 22 are watertight and adjust the buoyancy of personal watercraft 10. Sponsons 20, 22 are preferably constructed with a lightweight waterproof construction to resist impact deterioration and water penetration thereof. Preferably, sponsons 20, 22 and hull assembly 12 are constructed of a thermoformed ABS sheet material with weatherable cap, thereby providing a lightweight and robust construction. A flotation foam is disposed within the thermoformed ABS material of sponsons 20, 22, thereby providing a lightweight sponson construction that is sufficiently rigid to withstand impacts thereof. Furthermore, pickle fork shape 28 provides user control and operation of personal watercraft 10 that is foreign to known personal watercraft. Furthermore, protrusions 24, 26 reduce operator impact associated with operation over rough water, such as wakes and/or waves. Pickle fork shape 28 formed by removable sponsons 20, 22 stabilizes operation of the personal watercraft 10 and provides a unique personal watercraft experience.

Seat 17 is preferably formed from a closed foam 30, which provides a first suspension feature 32 of the present invention. That is, seat 17 is constructed to absorb some of the impact associated with operator separation therefrom. Seat 17 is elevated a variable distance 34 above an upper surface 36 of sponsons 20, 22. A pad 38 is attached to upper surface 36 of each sponson 20, 22 and is configured to engage an operator's knees and shins or elbows and forearms providing for variable prone operator orientations.

A maneuvering system or steering mechanism 40 passes through hull assembly 12 proximate a forward portion 42 thereof. A control, e.g., a handle, or handlebar 44 is connected to personal watercraft 10 within distance 34 between topside 14 of hull assembly 12 and upper surface 36 of sponsons 20, 22. Handlebar 44 is offset from topside 14 of hull assembly 12. A throttle control 46 is preferably connected to handlebar 44 and is constructed to control an operating speed of an engine of personal watercraft 10. Rotation of handlebar 44 about a pivot 48 controls a direction of discharge of water from a water jet pump of personal watercraft 10 and thereby controls the direction of travel of personal watercraft 10 similar to a motorcycle and/or bicycle steering control. An operator can comfortably rest his or her chest upon seat 17 with their arms extended forward over sponsons 20, 22 and engaged with steering mechanism 40. As such, an operator can non-strenuously control the speed and direction of the operation of personal watercraft 10.

An optional pole 50 is connected to personal watercraft 10 and extends above topside 14 thereof. A flag 52 is attached proximate an end 54 of optional pole 50, thereby enhancing the visibility of personal watercraft 10 when operated upon a water surface. Hull assembly 12 also includes an optional storage compartment 56 pivotably connected thereto. Optional storage compartment 56 is pivotably connected to the hull assembly such that users thereof can conveniently store other recreational accessories, such as sunglasses and/or sunscreen. Storage compartment 56 is also constructed to retain an optional strap that is further discussed with respect to FIG. 4. Storage compartment 56 sealingly engages hull assembly 12 such that items stored therein remain dry during operational use of personal watercraft 10. Alternatively, it is appreciated that storage compartment 56 be fonned in one or both of sponsons 20, 22.

Figure 2:
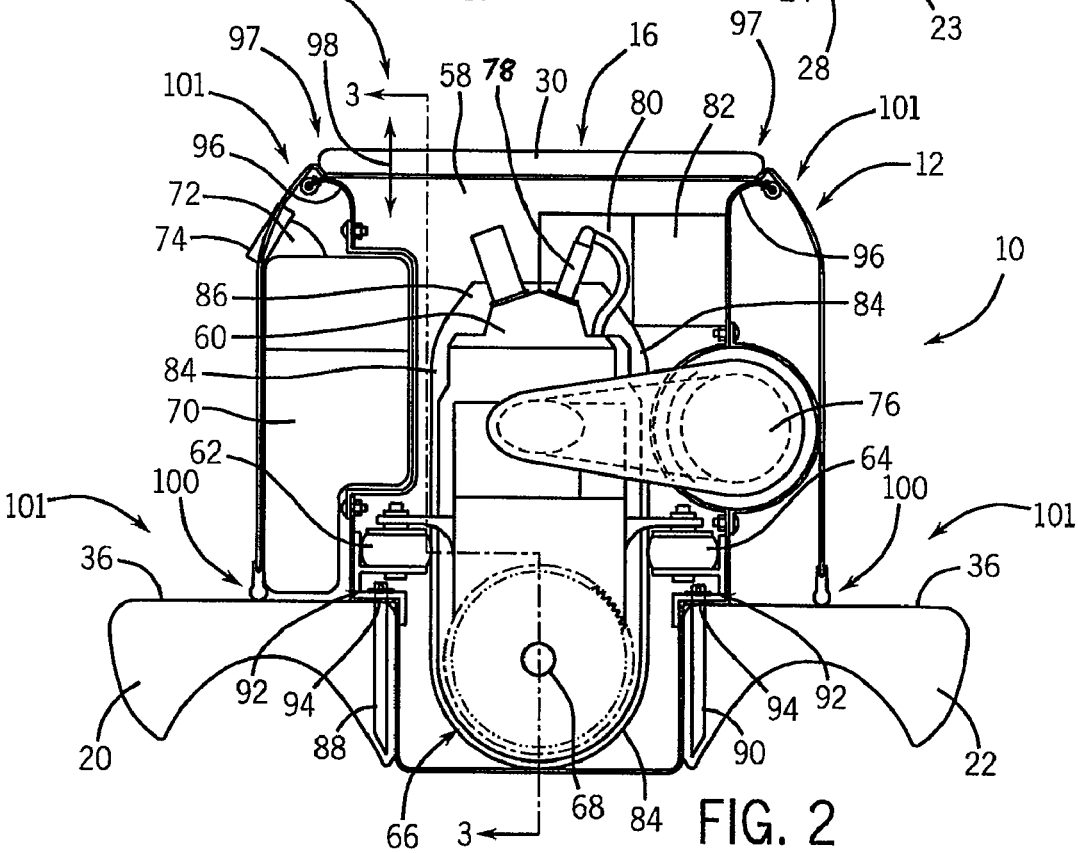
FIG. 2 is an elevational view of a cross-section of the personal watercraft shown in FIG. 1.
Figure 3:
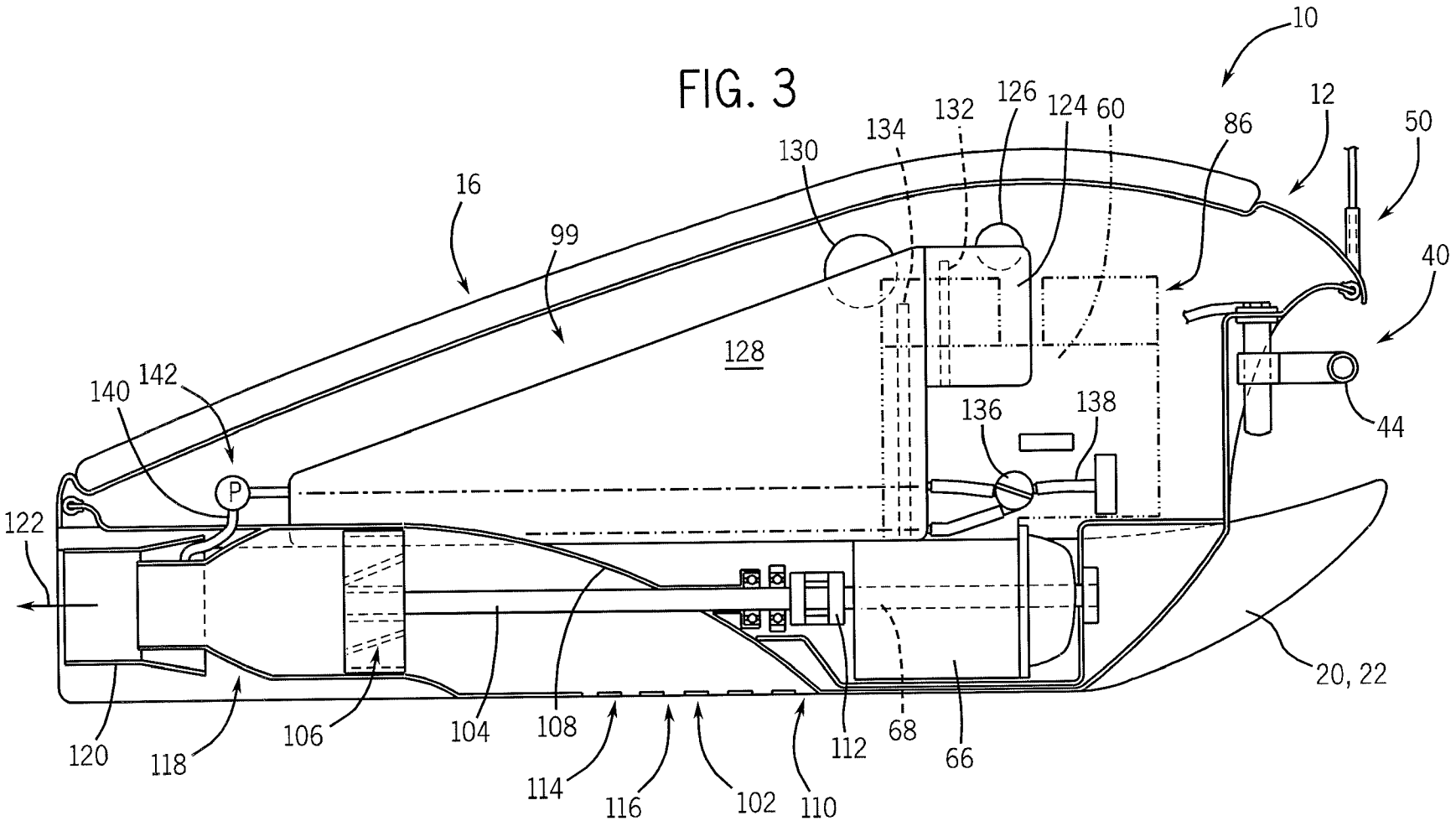
FIG. 3 is an elevational view of a cross-section of the personal watercraft shown in FIG. 2 taken along line 3-3.

FIG. 2 shows a cross-section of personal watercraft 10 exposing an engine compartment 58 formed by hull assembly 12. An engine 60 is disposed within engine compartment 58 and a plurality of engine mounts 62, 64 secure engine 60 thereto. Engine 60 includes a crankcase 66 having a crankshaft 68 that extends therefrom and is operably connected to a water jet pump that is described further with respect to FIG. 3. Preferably, engine 60 is a two-cycle engine, although other engine configurations, such as a four-cycle engine, would perform equally as well. Understandably, modification to the engine will affect the weight, and therefore the transportability, of personal watercraft 10. A fluid reservoir 70 includes a fill neck 72, which sealingly passes through hull assembly 12, thereby allowing an operator to fill fluid reservoir 70 without removing any components of personal watercraft 10 other than a reservoir cap 74. Understandably, depending on the configuration of engine 60, fluid reservoir 70 is configured to contain oil, fuel, or an oil/fuel mixture. Where fluid reservoir 70 contains one of oil or fuel, an additional fluid reservoir is provided for the alternate fluid. Understandably, if fluid reservoir 70 is constructed to contain fuel, engine 60 can be constructed to include an oil reservoir within crankcase 66 or, alternatively, the additional fluid reservoir previously disclosed can be provided. Preferably, personal watercraft 10 includes separate and removable engine fluid reservoirs as shown in FIG. 3. Still referring to FIG. 2, engine 60 is fluidly connected to an expansion chamber 76, which communicates combustion byproducts from engine 60 to atmosphere. A spark plug 78 is connected to an ignition control system 80, which is connected to a battery 82. Such a configuration facilitates electronic starting of engine 60. Alternatively, personal watercraft 10 could be equipped with a pull start.

A sleeve 84 snugly surrounds engine 60, and is constructed to have cooling water passed therebetween forming a watertight area or a water jacket 86 about engine 60. Preferably, sleeve 84 is lightweight and pliable, thereby allowing the weight of engine 60 to be reduced by removing the cooling function structure commonly associated therewith. More preferably, sleeve 84 is formed of a thermoplastic material formed around engine 60. Commonly such engines include a water jacket that is integrally formed in the engine or a plurality of fins that extend from the engine and are constructed to dissipate operational heat therefrom. Although such constructions provide a relatively robust engine, such constructions also substantially increase the weight of the watercraft. Referring back to FIG. 2, cooling water is circulated through water jacket 86 from an operating environment and returned thereto, thereby allowing the cooling fluid to be removed from personal watercraft 10 during non-operation. That is, engine 60 is constructed without integral cooling fins or a closed loop cooling system thereby providing a comparatively lightweight engine powered water jet powered personal watercraft. Understandably, the spacing between engine 60 and sleeve 84 is determined to provide adequate water-cooling of engine 60 without requiring excessive water flow through personal watercraft 10.

A securing means or pin 88, 90 is secured to each of sponsons 20, 22 and is removably engaged with personal watercraft 10. The head portion 92 of each pin 88, 90 passes through an opening 94 formed in hull assembly 12, extends into engine compartment 58, and is secured thereat. Understandably, any of the nut, hole and roll or cotter pin, or associated threaded engagement removably secures pins 88, 90 to hull assembly 12. Preferably, pins 88, 90 are toollessly attached and removed from personal watercraft 10. Head portions 92 extend through hull assembly 12 fore or aft of engine mounts 62, 64 such that an operator can conveniently and expeditiously remove sponsons 20, 22 from personal watercraft 10 when so desired.

Proximate topside 14 of personal watercraft 10, a deflector, e.g., gasket or seal 96 is disposed between seat 17 and cowling 16 and hull assembly 12. This seals a joint 97 therebetween. Seal 96 is deformable and/or deflectable such that, during operation of personal watercraft 10, seat 17 deflects in a direction, indicated by arrow 98, responsive to operator impacts therewith. Another deflector, e.g., seal 100 engages sponsons 20, 22 and functions substantially similar to seal 96. That is, seal 100 both seals the connection between hull assembly 12 and sponsons 20, 22 and absorbs a portion of the shock associated with operator impact with seat 17. Accordingly, in conjunction with first suspension feature 32, seals 96, 100 of personal watercraft 10 are constructed to provide a second suspension feature 101 for further reducing any operational impacts that may be communicated to an operator.

FIG. 3 shows a cross-section of personal watercraft 10 taken along line 3-3 shown in FIG. 2. A water jet engine or engine powered water jet 99 is connected to hull assembly 12. Personal watercraft 10 includes a water jet, e.g., a jet pump assembly 102 having a shaft 104 and an impeller 106 connected to the shaft. Shaft 104 extends through a wall 108 of a tunnel 110 of jet pump assembly or barrel 102. Preferably, shaft 104 and impeller 106 are formed of a fiber glass, a fiber wrapped, or a molded plastic material. An end 112 of shaft 104 is operatively connected to crankshaft 68 of engine 60. During rotation of impeller 106, water is drawn through a grate 114 positioned over an inlet 116 of tunnel 110. Grate 114 prevents debris or other materials from entering tunnel 110 and interfering with the operation of impeller 106. Water is drawn through inlet 116 by impeller 106, passes through a venturi section 118 of jet pump assembly 102, and into and through a steerable nozzle 120 that is pivotably connected to jet pump assembly 102. Nozzle 120 is operatively connected to steering mechanism 40 such that operator manipulation of handlebar 44 results in movement of steerable nozzle 120, to direct the direction of a water jet or discharge, indicated by arrow 122, from nozzle 120. The direction of discharge 122 controls the direction of travel of the personal watercraft 10. Accordingly, an operator positioned upon seat 17 can easily and efficiently control the direction and speed of travel of personal watercraft 10 via manipulation of handlebar 44 and throttle control 46.

An oil tank or oil reservoir 124 is disposed within hull assembly 12 and includes a fill neck 126, which extends therethrough. A gas or fuel tank 128 is also disposed within housing or hull assembly 12, and also includes a fill neck 130 that extends therethrough. Oil reservoir 124 and fuel tank 128 each include a level indicator 132, 134, respectively, such as a sight tube, to indicate the fluid level contained therein. Additionally, it is further understood that hull assembly 12 includes an optional transparent portion (not shown) such that the level of oil reservoir 124 and fuel tank 128 can be assessed without disassembly or movement of any components of personal watercraft 10. Oil reservoir 124 and fuel tank 128 are operatively connected to engine 60 via a mixing valve assembly 136. Understandably, for those engine constructions wherein engine oil is contained within a reservoir of crankcase 66, mixing of engine oil with fuel is unnecessary. Mixing valve assembly 136 fluidly isolates oil reservoir 124, fuel tank 128, and engine 60 when valve assembly 136 is oriented in a "closed" position. Such a construction allows oil reservoir 124 and fuel tank 128 to be removed from personal watercraft 10 without emptying the reservoir and tank via separation of connection line 138. Accordingly, for servicing of personal watercraft 10, sponsons 20 and 22 along with the cowling 16 and seat 17 can be removed from the body or power pod 12, as well as oil reservoir 124 and fuel tank 128, thereby providing a comparatively lightweight subassembly, which can be conveniently shipped for servicing thereof.

Proximate the venturi section 118 of jet pump assembly 102; a fluid line 140 fluidly connects a water flow through jet pump assembly 102 with water jacket 86. Alternatively, an optional pump 142 could be connected to fluid line 140 and constructed to extend through body or hull assembly 12, thereby fluidly connecting with the water jacket 86 of the operating environment. Accordingly, during non-operation of the personal watercraft 10, the engine cooling fluid is completely removed from personal watercraft 10, thereby reducing the non-operating transportation weight of personal watercraft 10.

3. In Use and Operation

Due to the compact construction of personal watercraft 10, the removable nature of sponsons 20, 22, and drainable engine cooling system, personal watercraft 10 is envisioned to be easily and conveniently transported by a single operator. That is, personal watercraft 10 preferably weighs less than approximately 80 pounds, and can be easily transported by a single operator. Furthermore, the removal of oil reservoir 124, fuel tank 128, cowling 16, and seat 17 facilitates even further weight reduction of the transportable portions of personal watercraft 10. That is, where an operator is incapable of individually transporting the approximately 80-pound assembly, the oil reservoir and the fuel tank can be removed therefrom and transported via a second user. The removable nature of the engine fluid containers also facilitates convenient shipping of personal watercraft 10 for remote servicing or more than portage transportation of personal watercraft 10.

Figure 4:
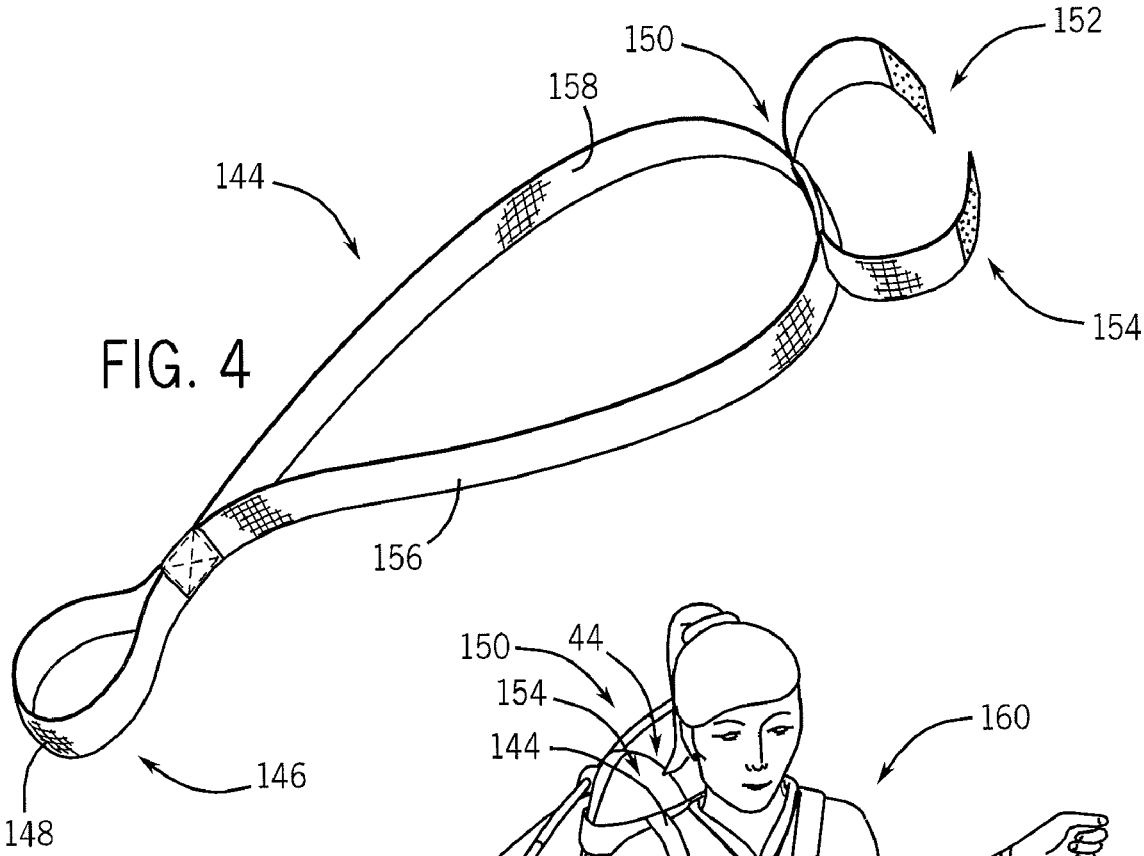
FIG. 4 is a perspective view of a strap assembly for use with the personal watercraft shown in FIG. 1.

As shown in FIG. 4, the present invention includes an optional removable strap 144 constructed to engage personal watercraft 10. Strap 144 has a first end 146 with a loop 148 formed thereat and a second end 150 having a separable loop 152 formed thereat. A snap clip assembly 154 separates loop 152 such that it can be positioned around handlebar 44 of personal watercraft 10. Loop 148 is constructed to slidably engage nozzle 120. A pair of shoulder straps 156, 158 extend between loop 148 and separable loop 152 and are constructed to engage an operator's shoulders such that, during non-operation of personal watercraft 10, an operator can simply transport the personal watercraft 10 in a backpack-type manner. Alternatively, it is also envisioned that sponsons 20, 22 or hull assembly 12 be equipped with associated wheel assemblies at an aft portion thereof such that an operator can simply transport the personal watercraft 10 in a manner substantially similar to rollable luggage.

Figure 5:
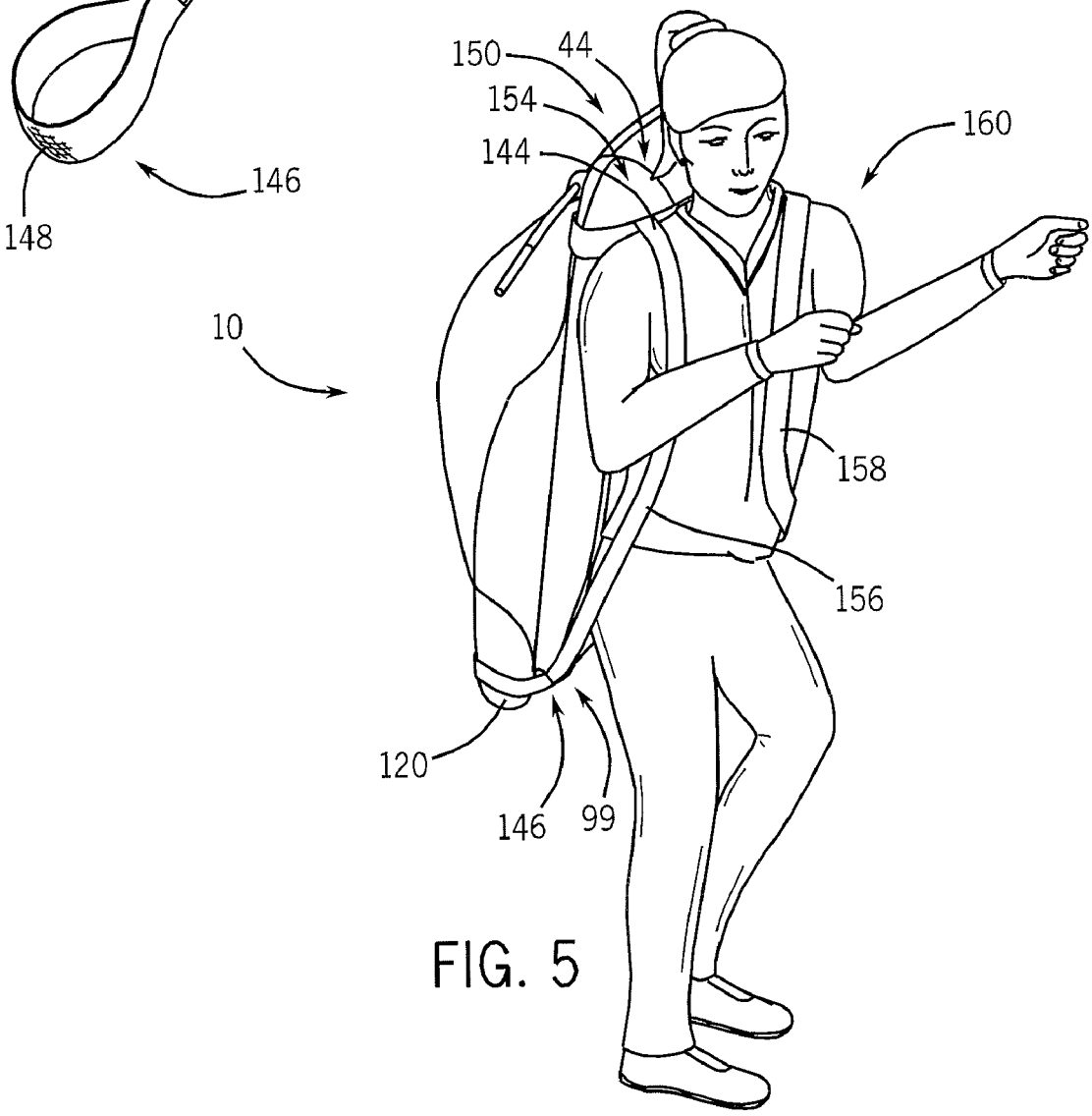
FIG. 5 is a perspective view of the personal watercraft shown in FIG. 1 with the sponsons removed from the watercraft and the strap assembly attached thereto.

As shown in FIG. 5, strap 144 facilitates expedient and efficient transportation of personal watercraft 10. First end 146 of strap 144 is positioned about nozzle 120 of water jet 99. Shoulder straps 156, 158 extend therefrom and are constructed to engage an operator 160. Second end 150 of strap 144 removably engages handlebar 44 via snap clip assembly 154. As shown in FIG. 5, the sponsons have been removed from personal watercraft 10, thereby reducing the load operator 160 is required to transport. Understandably, other operators may be able to transport personal watercraft 10 with the sponsons connected thereto.

In one embodiment, the hull assembly 12 may be made from a frame that is preferably constructed of hollow tubes formed in triangular configurations. The tubes are preferably made of aluminum, titanium, or some other rigid, strong and lightweight material. Such a tubular space frame is known in the Formula One racecar arena as well as in the construction of Bucatti motorcycles. Instead of a tubular frame, the frame may be made out of a honeycomb material. The frame may be also covered or skinned with fiberglass, rolled aluminum, or some other strong and lightweight material. In one embodiment, the tubular frame may actually protrude out from the skin and be visible to the eye.

In another embodiment, the water jet may include a barrel that encompasses the pump. The barrel may be inside the hull assembly or mounted under the space frame to the outside bottom portion of the space frame so that it is not actually inside the hull. Such a barrel may be mounted with fastening straps or bands directly to the hull assembly.

4. Alternative Embodiment

Figure 6:
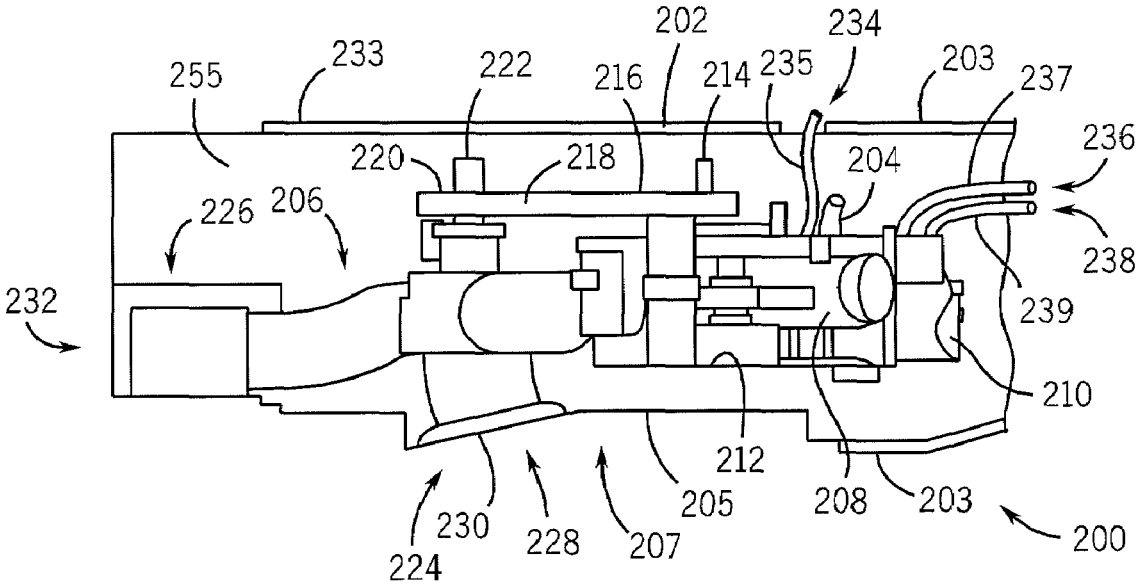
FIG. 6 is an elevational view of a personal watercraft power system according to another embodiment of the present invention.

FIGS. 6-9 show an alternative embodiment of the invention. As shown in FIG. 6, a watercraft power pod or power system 200 includes a body or housing 202 constructed to enclose the propulsion generating components or systems of a watercraft. Understandably, watercraft constructed for use with power system 200 could have any of a number of forms including a prone position watercraft such as watercraft 10, other personal watercraft such as those constructed to support an operator in a seated or standing position, or other watercraft such as inflatable or solid form rafts, etc. As such power system 200 provides a highly versatile watercraft power system.

Housing 202 is preferably constructed to removably engage a housing or hull 203 of a watercraft such that the propulsion generating system can be removed from the watercraft while contained in housing 202. A bottom surface 205 of housing 202 is constructed to be generally aligned with the planing surface of hull 203 thereby providing a relatively continuous planing surface of a watercraft equipped with power system 200.

Power system 200 includes an engine 204 and a propulsion means or pump such as a centrifugal pump assembly 206. Engine 204 includes a block 208 having a head 210 connected thereto. A crankcase 212 is connected to block 208 generally opposite head 210. A crankshaft 214 extends from crankcase 212 and has a pulley 216 connected thereto such that operation of engine 204 rotates crankshaft 214 and pulley 216. An endless drive, such as a belt 218 extends between pulley 216 and a pump pulley 220 operatively connected to a pump shaft 222. Pump shaft 222 is connected to a centrifugal impeller (264 shown in FIG. 8) generally disposed between an inlet 224 and an outlet, discharge, or discharge nozzle 226 of pump assembly 206.

A first opening 228 is formed through housing 202 proximate inlet 224 such that housing 202 is sealingly connected about inlet 224. A screen or weed grate 230 is positioned over inlet 224 and is constructed to prevent the passage of weeds or other debris into inlet 224 of pump assembly 206. An optional channel 207 can be formed in bottom surface 205 of housing 202 to assist in the directing of water passing over bottom surface 205 to inlet 224. A second opening 232 is formed in housing 202 proximate discharge nozzle 226 and is sealingly connected thereabout. First opening 228 and second opening 232 are constructed to sealingly engage pump assembly 206 so that water from the operating environment cannot enter the cavity between housing 202 and engine 204 and pump assembly 206 from between the engagement of housing 202 and pump assembly 206. Housing 202 may also include an optional cover 233 sealingly connected to housing 202 and constructed to allow operator access to engine 204 and pump assembly 206.

A number of passages 234, 236, 238 are formed through housing 202 and are constructed to operatively connect power system 200 to fluid sources and control systems of a watercraft. That is, passages 234, 236, 238 are constructed to for example fluidly connect engine 204, via a number of connection lines 235, 237, 239 with an oil system, such as oil reservoir 124, a fuel tank, such as fuel tank 128, and a combustion gas source, such as atmosphere. It is appreciated that these connection lines can be any of a number of connection conduits including for example rigid pipes or flexible hoses and that the connection lines include a quick coupler constructed to allow tool-less connection of power system 200 to a watercraft and the control and fluid systems supported thereon. It is further appreciated that the number of connection lines may vary depending on the construction of the engine.

If engine 204 is a two-cycle engine, oil may be mixed with gas prior to delivery of the mixture to the engine. Alternatively, oil and fuel may be separately delivered to the engine and mixed thereat or proximate thereto. If engine 204 is a four cycle engine, no oil may be required to be communicated to the engine 204 through housing 202. It is appreciated that each of these engine types and configuration have their own respective advantages and engine 204 may be provided in any of these configuration depending upon a user's preference. Regardless of which engine configuration is selected, housing 202 is constructed to sealingly enclose engine 204 and pump assembly 206 such that the combined engine and pump assembly can be removed from a watercraft, such as watercraft 10, or from a hull of a watercraft. It is appreciated that any fluids required for operation of engine 204, regardless of the operational nature of the engine, be communicated to the engine via the appropriate size and number of connection lines 235, 237, 239. It is also appreciated that other connections may be required between housing 202 and a watercraft equipped therewith. For example, throttle controls, including associated wires and cables, whether mechanical or electrical, may be communicated through housing 202 to allow remote operation and control of the operation of engine 204 and pump assembly 206.

It is further appreciated that the shape of housing 202 shown in FIG. 6 is merely exemplary and other housing shapes are envisioned. That is, housing 202 is envisioned to be constructed to be removably secured to a watercraft and constructed such that power system 200 powers the watercraft when the power system is connected thereto.

Figure 7:
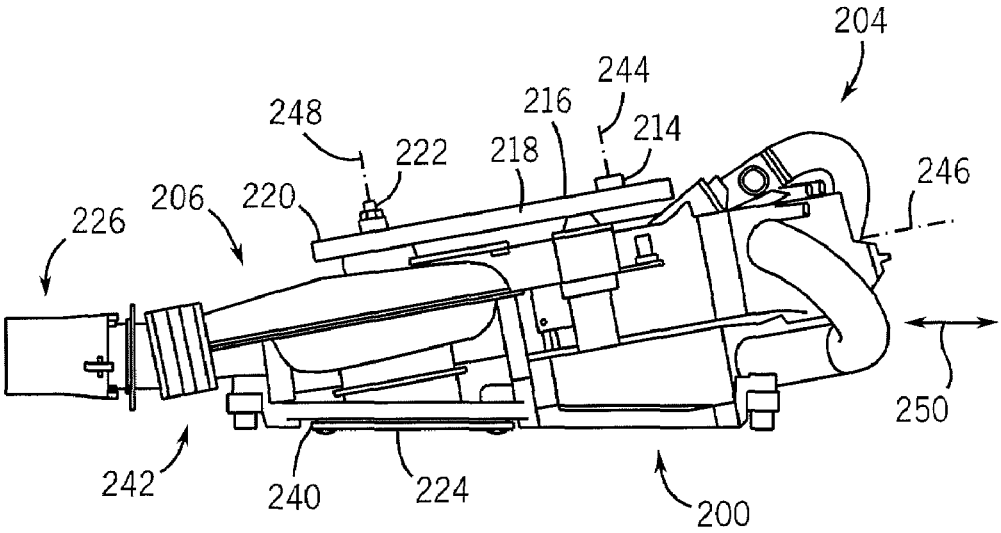
FIG. 7 is an elevational view of the power system shown in FIG. 6 with the housing removed from the power system.

Referring to FIG. 7, power system 200 is shown removed from housing 202. Power system 200 includes a first gasket assembly 240 positioned proximate inlet 224 of pump assembly 206. Gasket assembly 240 is constructed to sealingly connect housing 202 about inlet 224. Another gasket assembly 242 is positioned proximate nozzle 226 and is constructed to sealingly engage housing 202. Such a configuration isolates the interior of housing 202 from the operating environment thereby reducing the potential of water from the operating environment infiltrating housing 202.

An axis 244 of crankshaft 214 is generally perpendicular to an axis 246 of an engine cylinder of engine 204. Understandably, it is appreciated that preferably a piston is positioned in the engine cylinder and that engine 204 may include one or more such piston and cylinder associations. An axis 248 of pump shaft 222 is oriented generally parallel to crankshaft axis 244. Such a configuration generally aligns crankshaft pulley 216 and pump pulley 220 such that belt 218 is operationally supported therebetween. Engine cylinder axis 246 is generally aligned with a watercraft propulsion direction, indicated by arrow 250 or a water planing surface, whereas crankshaft 214 and pump shaft 222 are oriented in generally crossing directions with propulsion direction 250. Such a construction allows power system 200 to maintain a relatively low profile with respect to a planing elevation of a watercraft equipped with power system 200.

Figure 8:
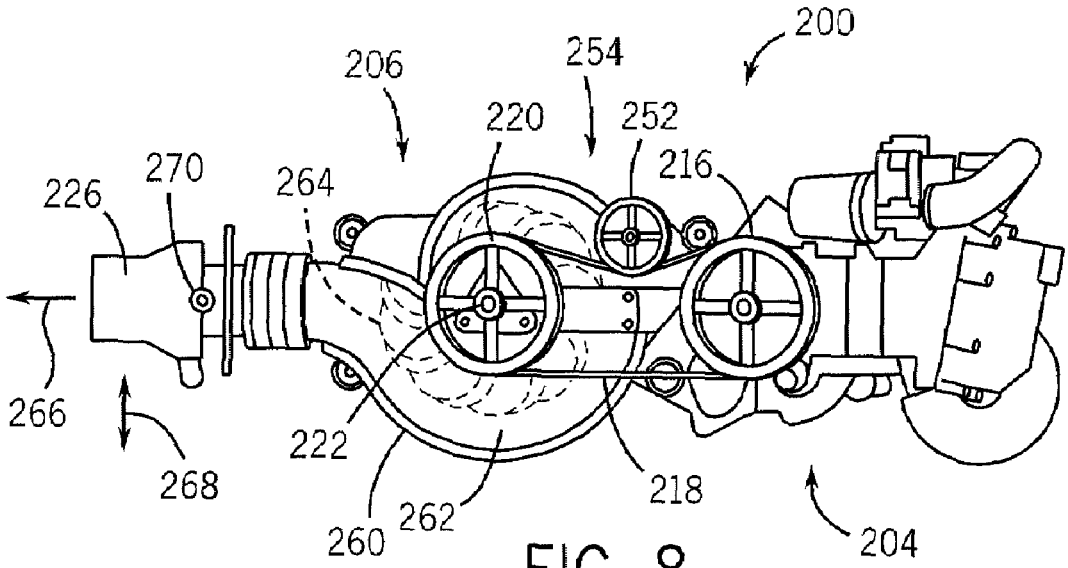
FIG. 8 is a top plan view of the power system shown in FIG. 7.
Figure 8A:
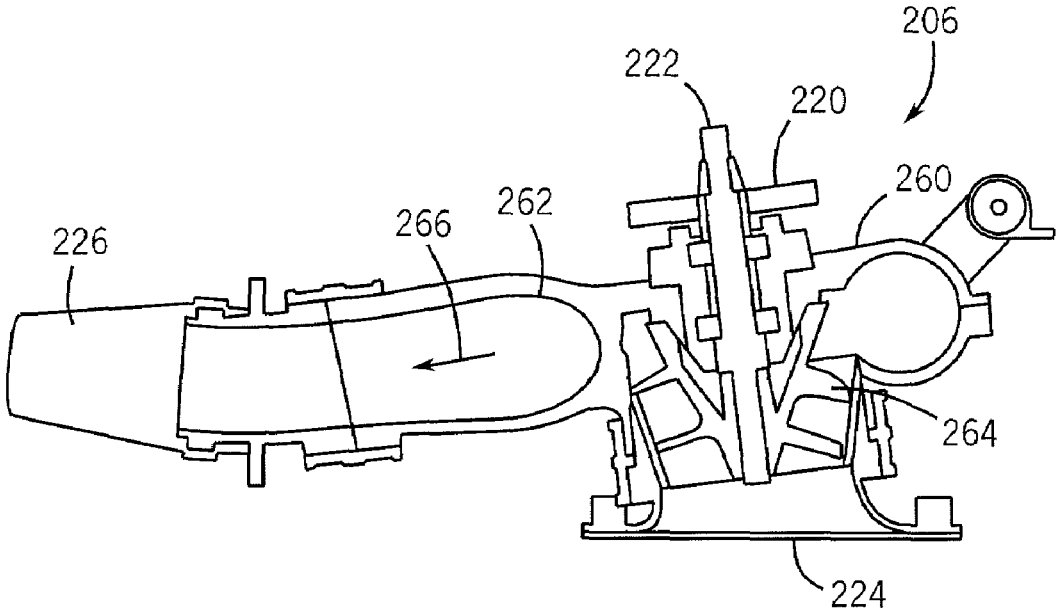
FIG. 8*a* a cross-sectional elevational view of a jet pump portion of the power system shown in FIG. 8.

Referring now to FIGS. 8 and 8*a*, belt 218 operatively extends between crankshaft pulley 216 and pump pulley 220. A tensioner 252 is positioned in a space 255, generally between crankshaft pulley 216 and pump pulley 220. Tensioner 252 is constructed to adjustably engage belt 218 to provide a desired tension to the belt 218. Such a construction ensures efficient communication of engine power to pump assembly 206 and provides a cost effective replaceable component in the event of obstruction enters inlet 224 which would interfere with the operation of a centrifugal impeller 264 of pump assembly 206. Although it is desired to precisely align crankshaft pulley 216 and pump pulley 220 for operative engagement with belt 218, belt 218 will tolerate a less than exact alignment of pulleys 216, 220. Furthermore, the flexible nature of belt 218 allows engine 204 and pump assembly 206 to be operatively coupled throughout 360 degrees of rotation of engine 204 relative to pump assembly 206. Such an orientation further enhances the versatile nature of power system 200. It is further appreciated that as disclosed herein, pump assembly 206 is centrifugal in nature in that, during operation of impeller 264, the discharge of the impeller acts in a direction away from a center axis of the impeller. A compact and efficient watercraft according to the present invention could utilize a centripetal-based pump, or a pump configured to direct a propulsion stream toward a center axis of the pump. Such a configuration would orient a water inlet at a periphery of the impeller rotation and a discharge more aligned with an axis of rotation of the impeller. Accordingly, power system 200 is operable with both centripetal and centrifugal type pump assemblies.

Pump assembly 206 includes a pump housing 260 having a fluid path 262 formed therein. Centrifugal impeller 264 is operatively connected to pump shaft 222 and disposed in fluid path 262. Operation of engine 204 rotates crankshaft pulley 216 which drives belt 218 and pump pulley 220. Rotation of pump pulley 220 rotates centrifugal impeller 264 within fluid path 262 and directs a propulsion discharge, indicated by arrow 266, which is directed through nozzle 226. Translation of nozzle 226 in directions, indicated by arrow 268 about a pivot pin 270 provides a lateral or directional thrust to a watercraft equipped with power system 200. It is further appreciated that pump assembly 206 be provided with a dump bucket to provide reverse propulsion to a watercraft equipped therewith. Understandably, such an option may not be required on all watercraft types, such as watercraft 10, where the weight of the watercraft allows convenient and non-strained movement of the watercraft. Furthermore, as compared to an axial flow pump commonly employed in personal watercraft power systems, centrifugal impeller 264 enhances the profile of power system 200 such that the power system is particularly useful for watercraft constructed to support an operator in a prone position, such as watercraft 10. The orientation of power system 200 further provides an inboard power system with a center of gravity that is closer to a water surface and positionable closer to a bow of a watercraft than many personal watercraft and most outboard power equipped watercraft.

Figure 9:
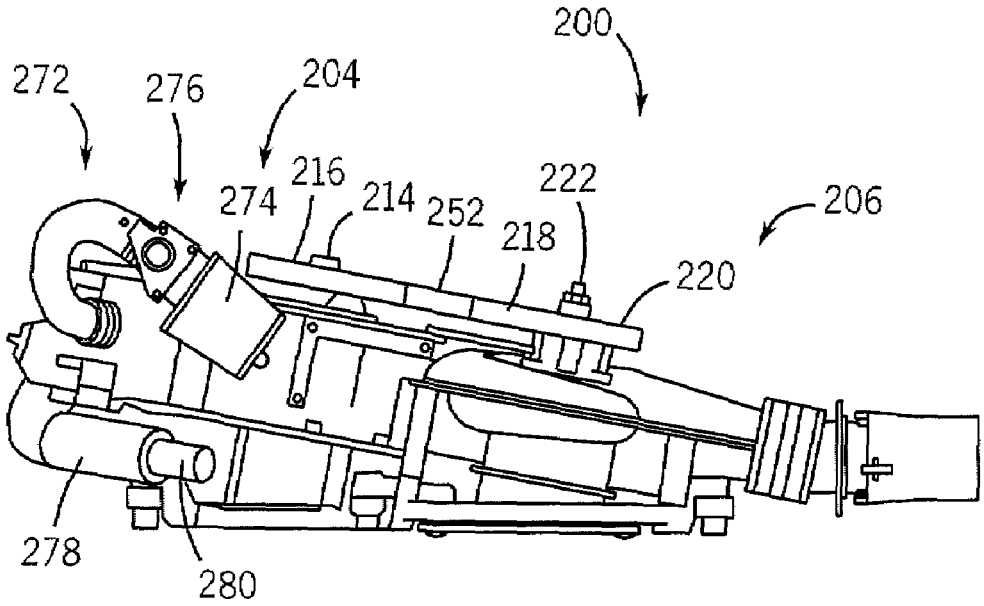
FIG. 9 is an elevational view of the power system shown in FIG. 7 from a side generally opposite the view shown in FIG. 7.

As shown in FIG. 9, engine 204 includes an air intake 272 having a snorkel 274 and an adjustable throttle 276. Snorkel 274 prevents intake 272 from drawing water which may be present between housing 202 and engine 204 into the combustion system of engine 204. Throttle 276 allows engine 204 to operate at variable speeds to provide variable speed operation of a watercraft equipped with power system 200. An exhaust manifold 278 is connected to engine 204 and is constructed to communicate engine exhaust gases through housing 202 to an operating environment. A valve 280 is disposed in the exhaust flow path and is constructed to limit water penetration into the watercraft via the exhaust system.

Figure 9A:
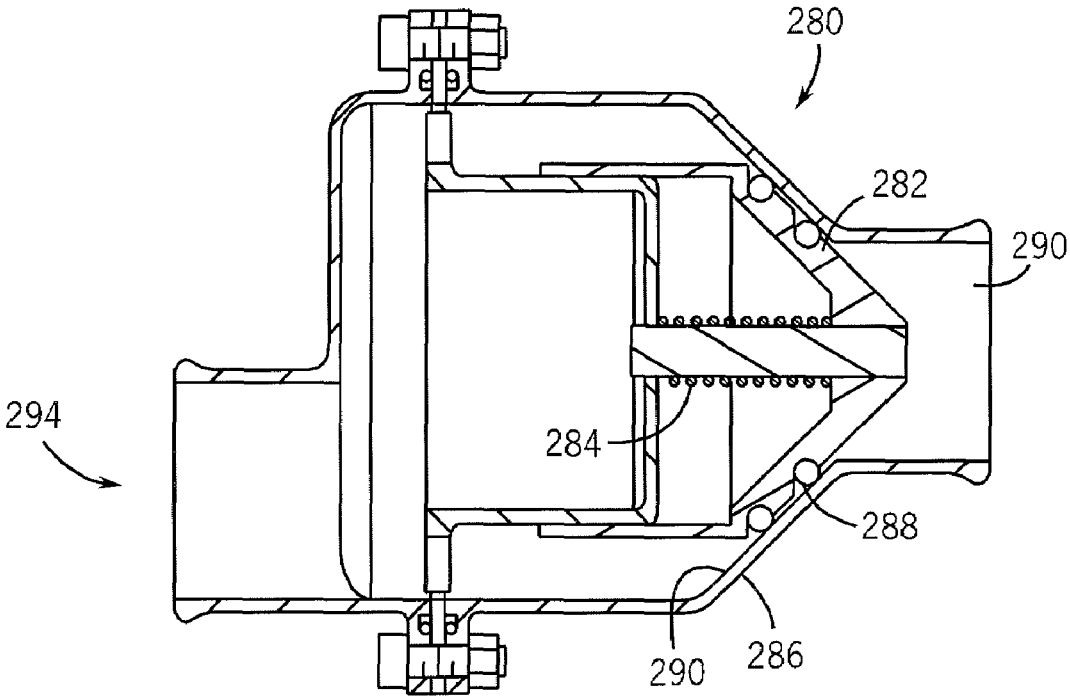
FIG. 9*a* is a cross-sectional elevational view of an exhaust valve of the power system shown in FIG. 9.
Figure 10:
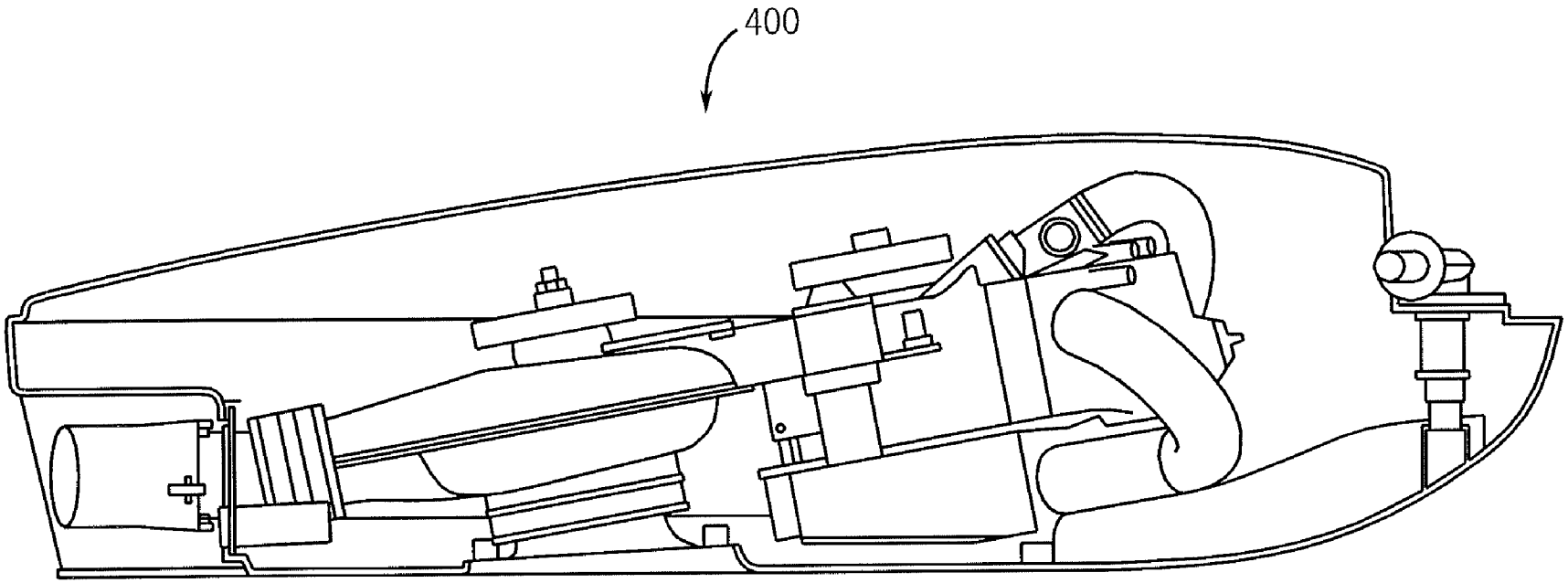
FIGS. 10-13*c* show a watercraft similar to the watercraft shown in FIG. 1 equipped with a power system similar to that shown in FIG. 6.
Figure 11:
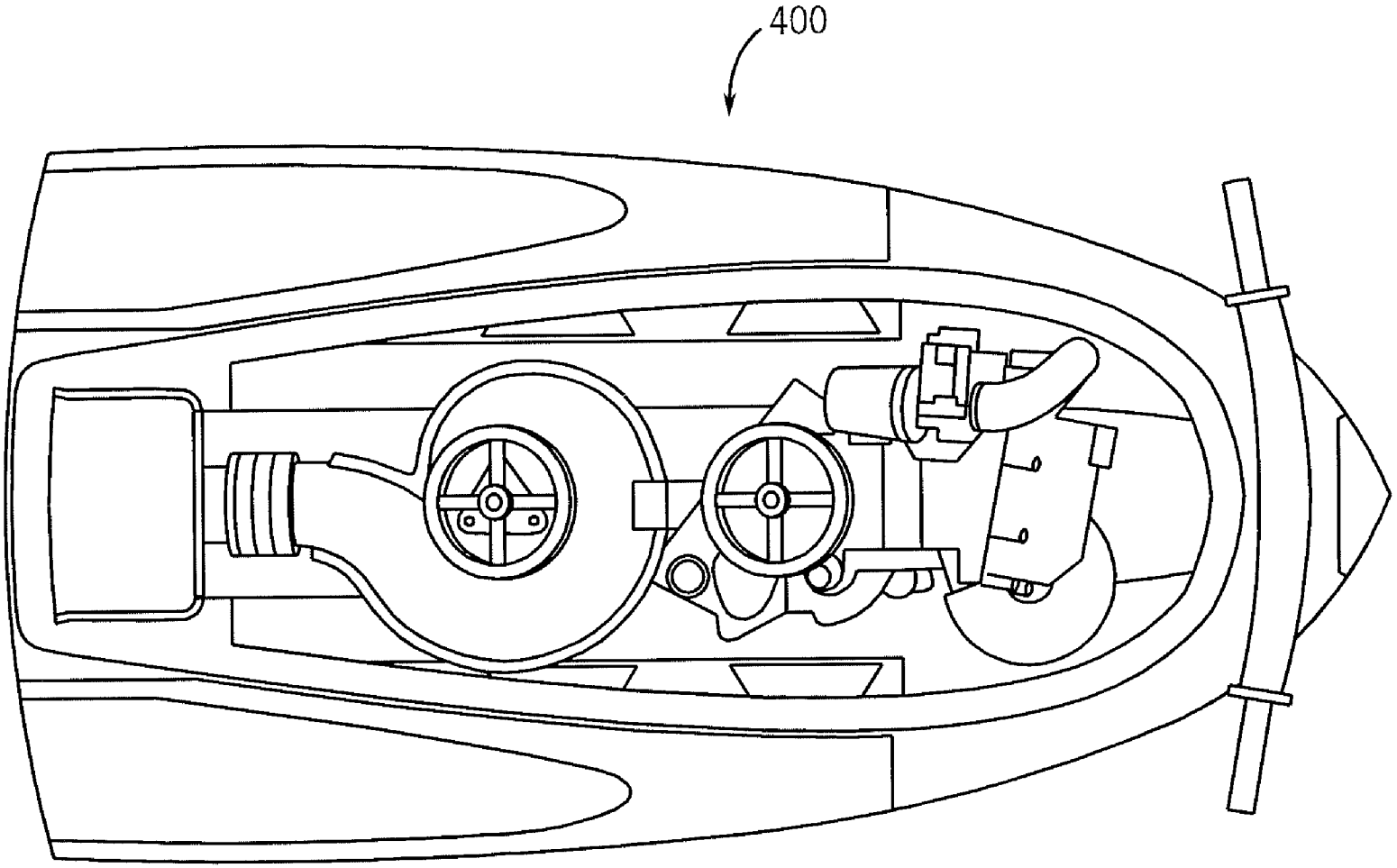
Figure 12:
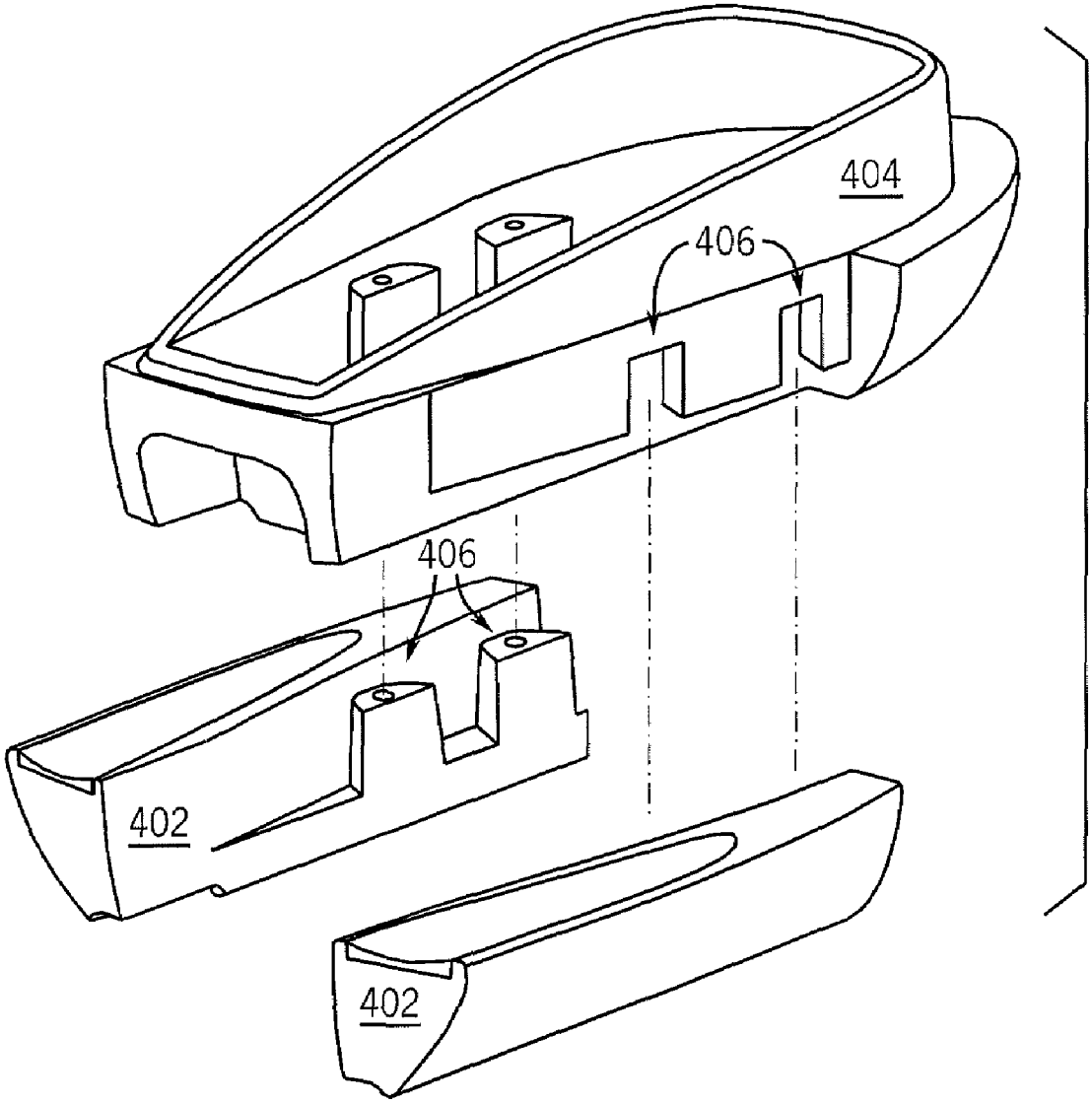

As shown in FIG. 9*a*, valve 280 includes a movable seal member 282 that is biased to a closed position by a spring 284. A body 286 of valve 280 includes a seat 288 formed on an interior surface 290 thereof. Spring 284 biases seal member 282 against seat 288 of interior surface 290 to fluidly isolate an engine side 292 of valve 280 from an atmosphere side 294 of valve 280. During operation of engine 204, as exhaust pressure overcomes the back pressure associated with spring 284 and atmospheric pressure, seal member 282 moves away from seat 288 and allows engine exhaust to vent to atmosphere. Such a construction allows accurate calibration of the engine exhaust back pressure as well as reducing the penetration of operating environment water into power system 200. It is appreciated that the exhaust gas may be discharged above or below a water surface. As stated above with respect to FIG. 7, although engine 204 is shown as a carburetion control engine having an adjustable throttle, it is appreciated that engine 204 can be configured to operate according to an electronic fuel injection paradigm for those watercraft equipped with such systems. It is further appreciated that engine 204 can be configured as either a two-cycle or a four-cycle engine as determined by user preference and/or watercraft performance requirements.

As previously discussed with respect to FIG. 7, the generally horizontal orientation of engine 204 in addition to the centrifugal operating nature of pump assembly 206, power system 200 provides a watercraft power system having a relatively shallow draft construction. FIGS. 10-13 show an exemplary incorporation of power system 200 into a watercraft 400. As shown in FIGS. 12 and 13*a-c*, a pair of removable sponsons 402 is constructed to removably engage a housing 404 of watercraft 400 via a number of connections 406. Connections 406 having a generally dove-tailed shape to allow sponsons 402 to be efficiently removed from housing 404 of watercraft 400.

Figure 13A:
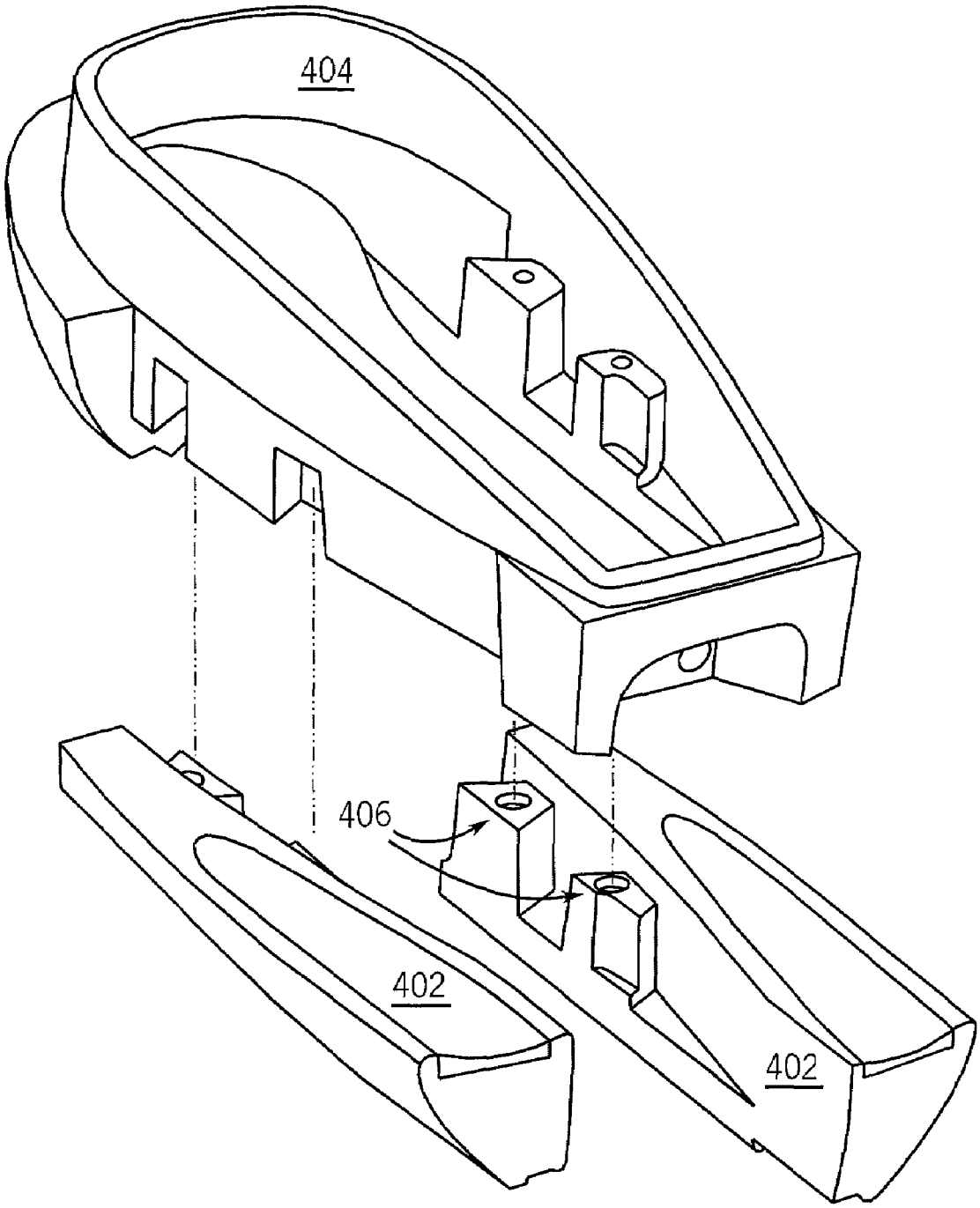
Figure 13B:
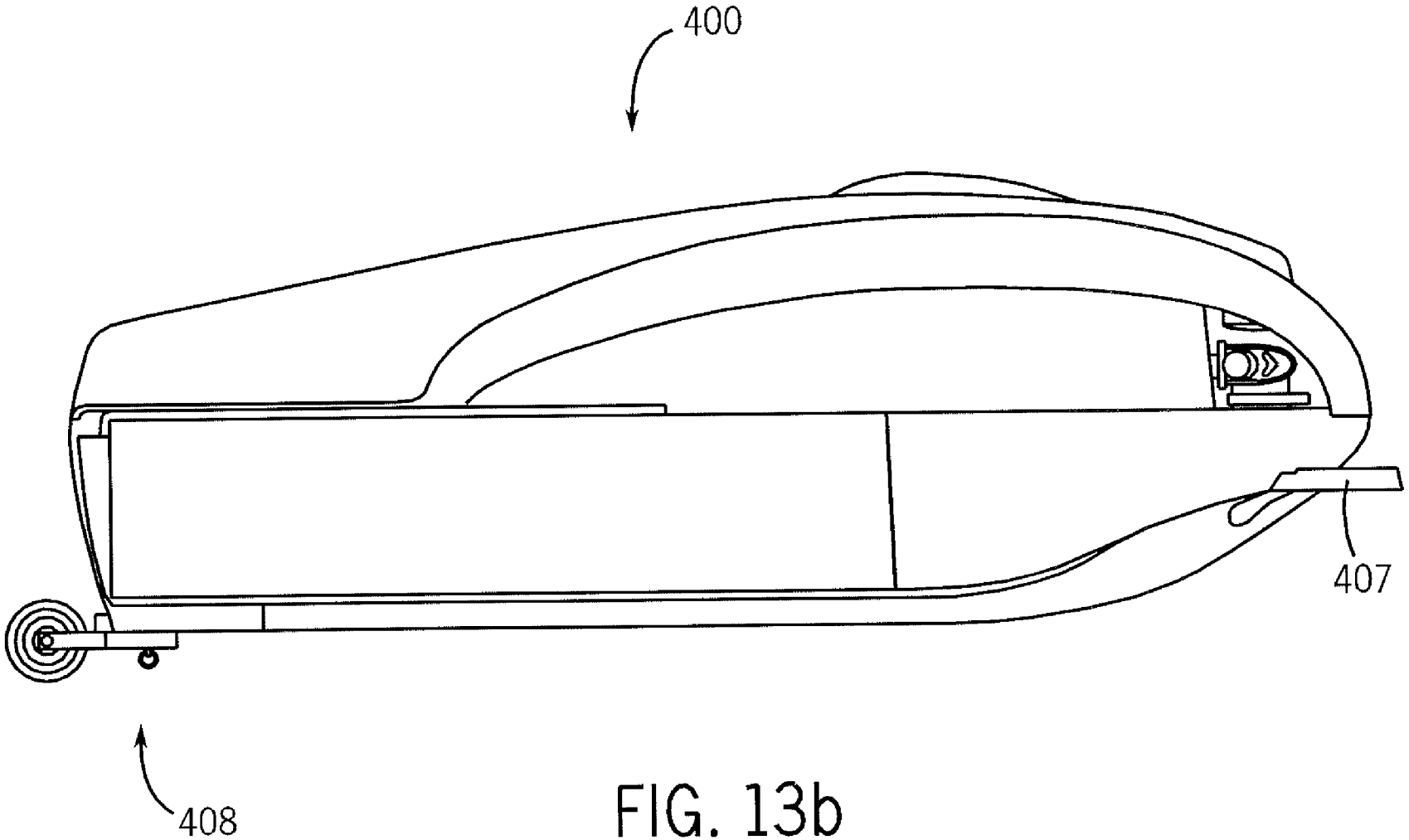
Figure 13C:
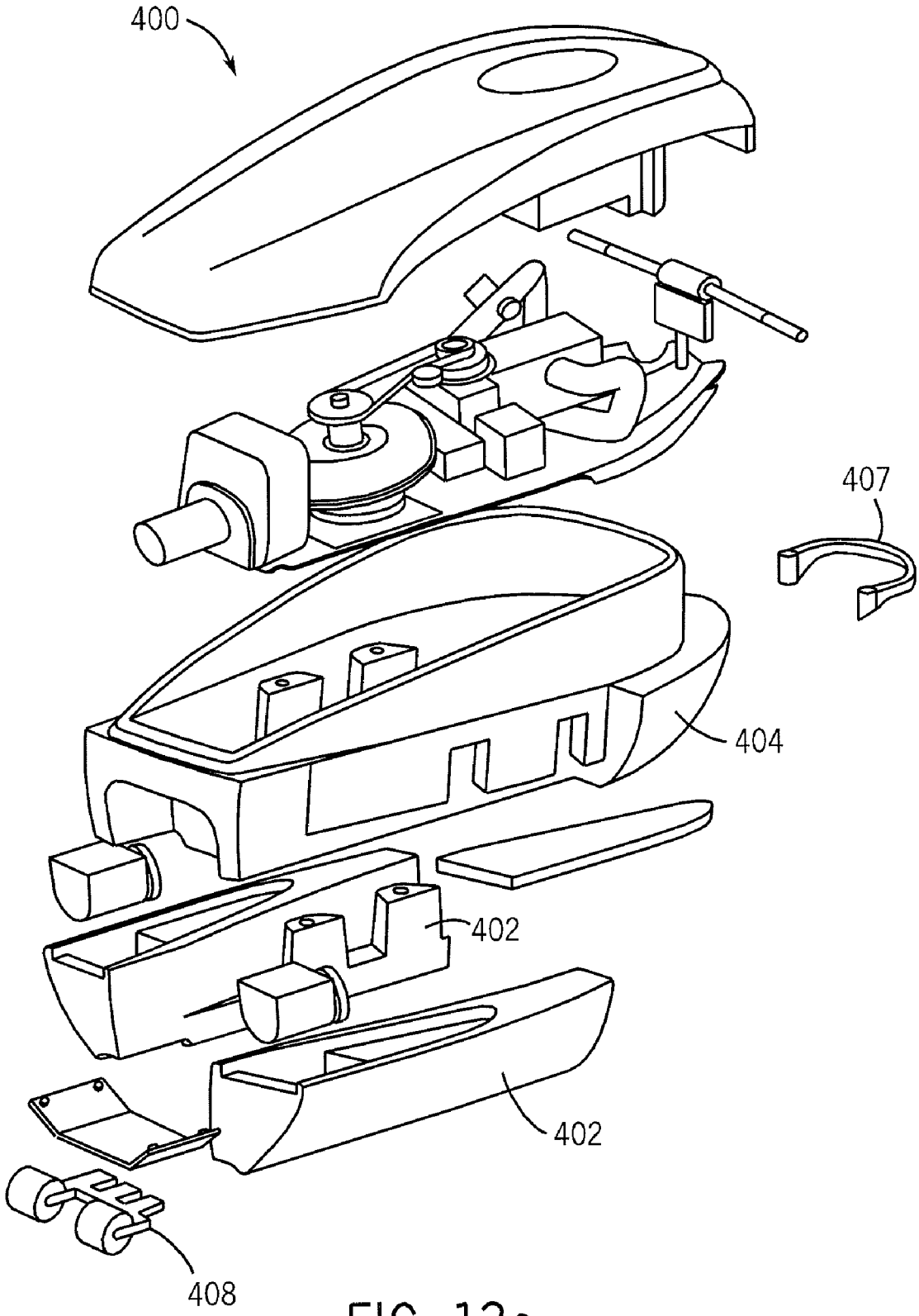

An optional handle 407 and wheel assembly 408 are connectable to watercraft 400 to assist in the simply and efficient transportation of watercraft 400 when removed from a water operating environment. A removable pin 409 secures wheel assembly 408 to watercraft 400 such that the wheels can quickly and easily be removed from the watercraft when portage is not required. FIG. 13*c* shows an exploded view of the assembly of watercraft 400 with handle 407 and wheel assembly 408 removed from housing 404 of watercraft 400.

Figure 14:
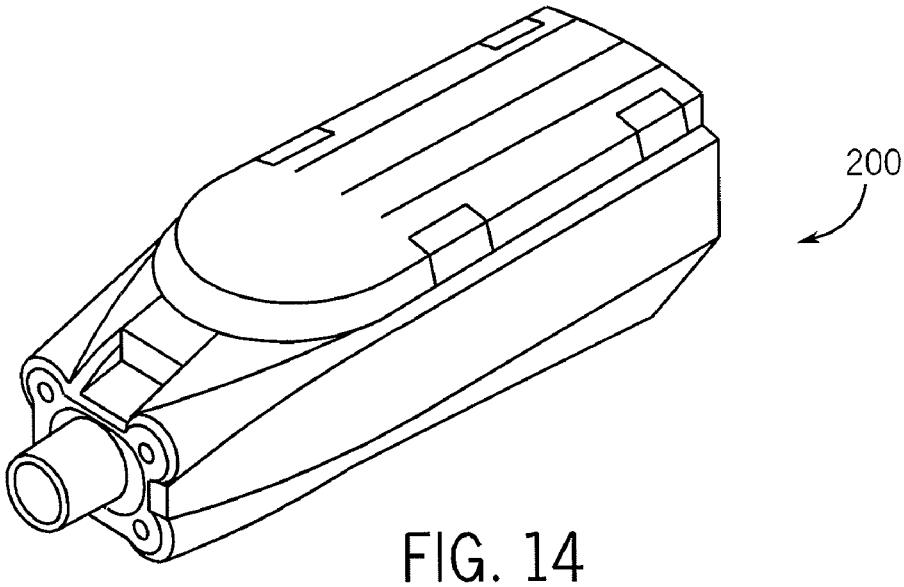
FIGS. 14-18 show the power system shown in FIG. 6 and various exemplary watercraft configurations achievable with the disclosed watercraft power system.
Figure 15:
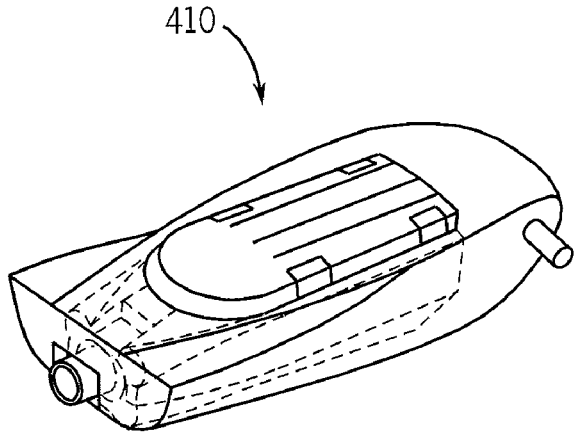
Figure 16:
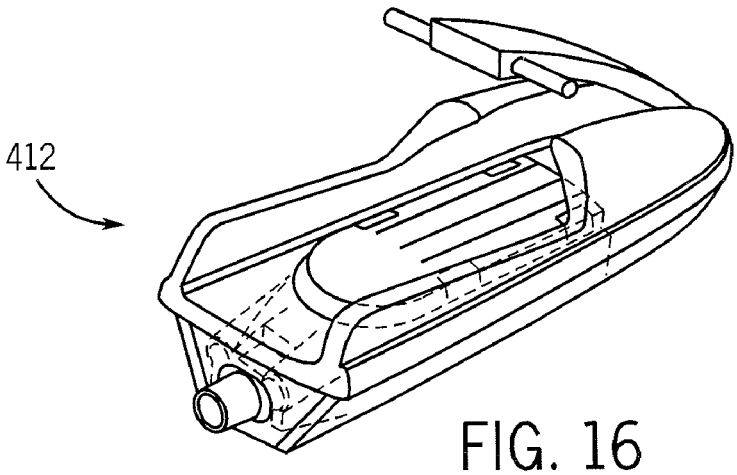
Figure 17:
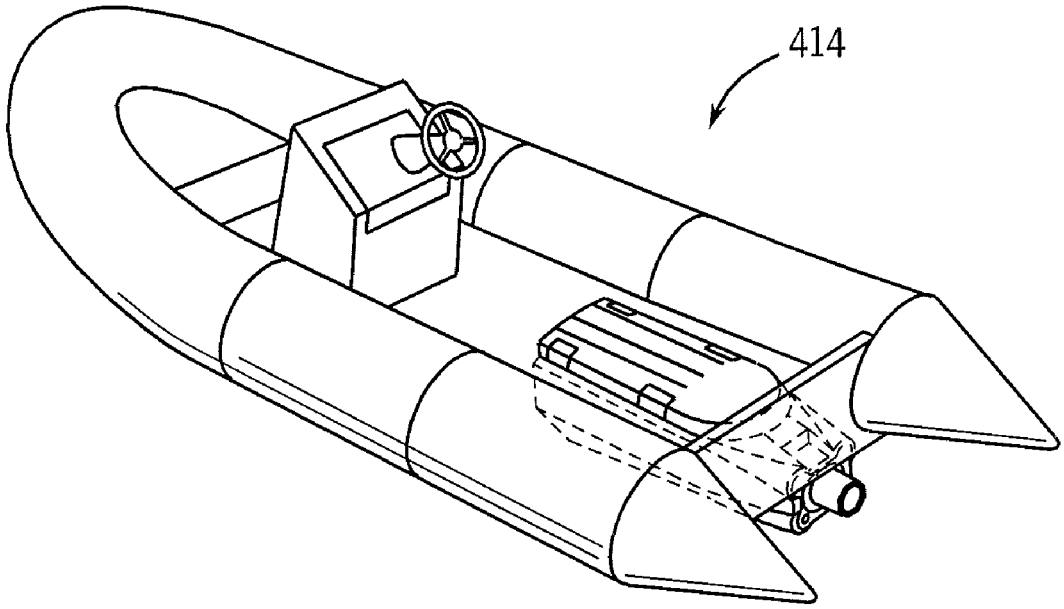
Figure 18:
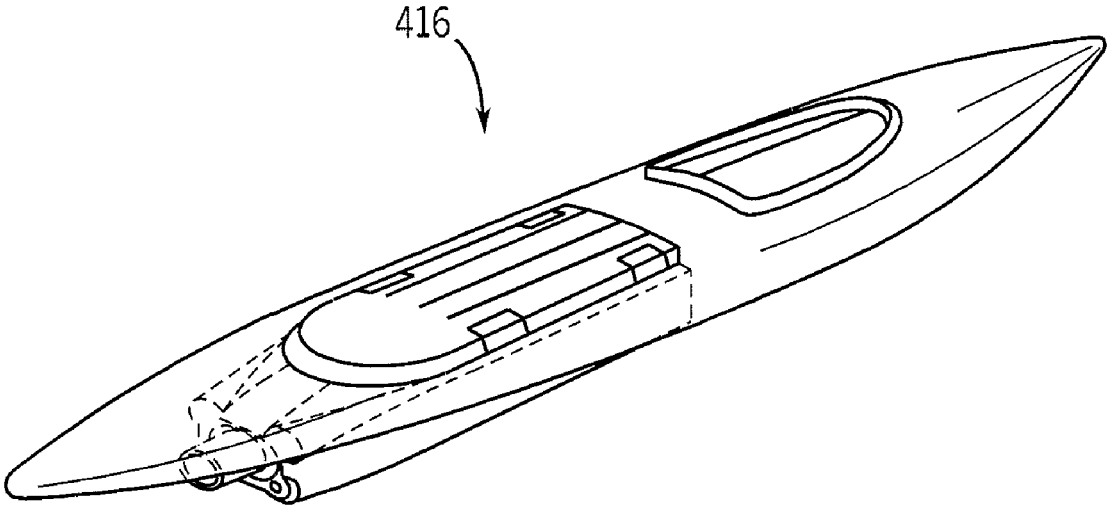

FIG. 14 shows power system 200 removed from a watercraft and FIGS. 15-18 show various watercraft configurations that can be achieved with power system 200. FIG. 15 shows a personal watercraft 410 generally similar to watercraft 10, FIG. 16 shows a watercraft 412 having a stand-up operating orientation, FIG. 17 shows a multi-person watercraft 414 such as an inflatable raft or the like, and FIG. 18 shows a watercraft 416 having a kayak configuration. Although, power system 200 is particularly applicable for use with those watercraft, such as watercraft 10, constructed to support an operator in a prone position, as housing 202 provides a movable container for power system 200, power system 200 can be quickly and efficiently exchanged between watercraft regardless of the specific construction or type of the watercraft. Such a construction provides a versatile, robust and compact watercraft power system.

The watercraft and power systems aspects disclosed herein provide a uniquely configured vehicle system that can be efficiently manufactured, delivered, and serviced. The construction of the watercraft such that the watercraft can be broken down into respective systems provides a watercraft system that can be conveniently transported via common carrier as the combustible fuel materials and containers can be quickly and efficiently removed from the watercraft system. Alternatively, the crankcase of the power system has a sealed construction such that the power pod can be transported by common carrier without fear of fluid leakage. Not only can a manufacturer of such a system efficiently distribute product, but customers can conveniently return entire products, or only portions thereof, to the original equipment manufacturer (OEM) for service or repair. Accordingly, the OEM can avoid the capital expenditure associated with forming a distribution network, as well as efficiently maintain the integrity of the parts and services associated with any repairs. Such a distribution and service paradigm allows the OEM to also monitor product performance and mortality as well as direct control of warranty servicing or the like. Even though others, particularly in the computer device arena, have somewhat similar distribution and service network systems, those systems are generally inapplicable to engine powered devices. That is, whereas computers can be conveniently shipped via common carrier, the inclusion of combustible fluids in engine powered devices, generally prevents such a network in the area of engine powered vehicles.

Generally, such systems are manufactured by an OEM, distributed by a carrier system frequently associated solely with the OEM, and sold and serviced by a number of remotely located distribution locations or associated franchises. Maintaining such a business model requires considerable initial investment and continued cooperation between the respective participants in the stream of product. A watercraft or power system according to the present invention can be manufactured and maintained by an OEM whereas known systems are ill-configured and constructed for such distribution and maintenance. By tailoring the product to satisfy the business operating paradigm, considerations, such as product packaging can be addressed and considered during product production to satisfy the return to OEM feature of the product.

The present invention has been described in terms of the preferred embodiment, and it is recognized that equivalents, alternatives, and modifications, aside from those expressly stated, are possible and within the scope of the impending claims. It is intended that the appended claims cover all such additions, modifications and rearrangements. Expedient embodiments of the present invention are differentiated by the appended claims.

What is claimed is:

1. A watercraft power system comprising:

an engine having a crankshaft and at least one piston wherein the plane of travel of each piston is generally horizontal;

a centrifugal pump having an inlet, a discharge, and a pump shaft that is generally parallel to the crankshaft, wherein the crankshaft and the pump shaft are generally oriented vertically;

an endless drive for operatively connecting the centrifugal pump to the engine; and a housing constructed for removably engaging a hull of a watercraft and positioned about the engine and the centrifugal pump, wherein the housing has a first opening for being positioned about the inlet, a second opening for being positioned about the discharge, and is at least partially disposed within the hull of the watercraft when engaged with the watercraft.

2. The watercraft power system of claim 1 further comprising at least one passage formed through the housing, the at least one passage constructed to fluidly connect at least one of a fluid reservoir, a gas tank, and a combustion gas source to the engine.

3. The watercraft power system of claim 1 wherein the endless drive is a belt.

4. The watercraft power system of claim 1 wherein the centrifugal pump includes an impeller having a plurality of blades.

5. The watercraft power system of claim 1 further comprising a nozzle movably connected to the discharge and connected to a control linkage of the watercraft.

6. The watercraft power system of claim 1 wherein a first end of the pump shaft and a first end of the crankshaft are positioned closer to the water than a second end of the pump shaft and a second end of the crankshaft and wherein the second end of the pump shaft and the second end of the crankshaft are both located on the top side of the power system.

7. The watercraft power system of claim 1 wherein the power system is compact and lightweight.

8. A watercraft power pod comprising:

an engine having a piston positioned in a cylinder and connected to a crankshaft wherein the plane of travel of the piston is generally horizontal;

a pump having a centrifugal impeller connected to a pump shaft wherein the pump shaft is generally parallel to the crankshaft and offset therefrom; and an endless drive for connecting the crankshaft to the pump shaft wherein the endless drive is generally parallel to and oriented at an upper end of both the crankshaft and the pump shaft.

9. The watercraft power pod of claim 8 further comprising a housing configured to enclose the engine, the pump, and the endless drive and removably engage a watercraft.

10. The watercraft power pod of claim 9 wherein the housing is configured to independently engage a watercraft having a first hull shape and another watercraft having another hull shape and wherein the housing is at least partially disposed within the hull of the watercraft when engaged with the watercraft.

11. The watercraft power pod of claim 9 wherein the endless drive is a belt.

12. The watercraft power pod of claim 11 further comprising a tensioner constructed to engage the endless drive for adjusting pressure between the endless drive and the crankshaft and the pump shaft.

13. The watercraft power pod of claim 9 further comprising a fuel connection extending through the housing and constructed to removably engage a fuel source contained in a hull of a watercraft.

14. The watercraft power pod of claim 8 wherein the orientation of the engine and the pump provides a low center of gravity for the power pod.

15. A removable watercraft power system comprising:

a centrifugal pump having an impeller generally aligned horizontally;

an engine having a cylinder generally aligned horizontally;

an endless drive connected between the engine and the centrifugal pump and generally parallel to the cylinder and the impeller;

a pump shaft connected to the impeller and the endless drive and extending in a direction generally perpendicular to the impeller;

a crankshaft connected to the engine and the endless drive and extending in a direction generally perpendicular to the cylinder and offset from the pump shaft; and a housing for removably engaging the power system with a hull of a watercraft, wherein the housing is at least partially disposed within the hull of the watercraft when engaged with the watercraft.

16. The removable watercraft power system of claim 15 wherein the housing further comprises a first opening constructed to be generally aligned with an inlet of the centrifugal pump and a second opening constructed to be generally aligned with a discharge of the centrifugal pump.

17. The removable watercraft power system of claim 16 wherein the first opening and the second opening are constructed to be generally aligned with openings formed in the hull of the watercraft when the power system is connected thereto.

18. The removable watercraft power system of claim 15 wherein the housing further comprises at least one passage formed therethrough, the at least one passage constructed to fluidly connect the engine to one of a fuel source, an air source, and an oil source positioned in the hull of the watercraft.

19. The removable watercraft power system of claim 15 wherein the housing is constructed to engage a first watercraft and a second watercraft.

20. The removable watercraft power system of claim 19 wherein the first watercraft has a hull configuration that is different than a hull configuration of the second watercraft.

* * * * *